US010870821B2

(12) United States Patent
Depoot et al.

(10) Patent No.: US 10,870,821 B2
(45) Date of Patent: Dec. 22, 2020

(54) WATER-SOLUBLE UNIT DOSE ARTICLE CONTAINING POLYETHYLENE GLYCOL PARTICLES

(71) Applicant: The Procter & Gamble Company, Cincinnati, OH (US)

(72) Inventors: Karel Jozef Maria Depoot, Anzegem-Vichte (BE); Jean-Pol Boutique, Gembloux (BE); Laura Orlandini, Le Mont-sur-Lausanne (CH); Megan Rose McCafferty, Cincinnati, OH (US); Nea Janette Lintula, Brussels (BE); Audrey Claire Francoise Bouniol, Brussels (BE); Katrien Andrea Lieven Van Elsen, Puurs (BE); Hugo Robert Germain Denutte, Hofstade (BE); Matthew Lawrence Lynch, Mariemont, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/370,146

(22) Filed: Dec. 6, 2016

(65) Prior Publication Data

US 2017/0175057 A1 Jun. 22, 2017

(30) Foreign Application Priority Data

Dec. 16, 2015 (EP) ..... 15200549

(51) Int. Cl.

| | |
|---|---|
| ***C11D 3/50*** | (2006.01) |
| ***C11D 17/04*** | (2006.01) |
| ***C11D 3/37*** | (2006.01) |
| ***C11D 3/22*** | (2006.01) |
| ***C11D 1/22*** | (2006.01) |
| ***C11D 1/29*** | (2006.01) |
| ***C11D 1/66*** | (2006.01) |
| ***C11D 1/83*** | (2006.01) |
| ***C11D 7/26*** | (2006.01) |
| ***C11D 1/72*** | (2006.01) |
| ***C11D 3/12*** | (2006.01) |
| ***C11D 17/00*** | (2006.01) |
| ***C11D 7/20*** | (2006.01) |
| ***C11D 3/32*** | (2006.01) |

(52) U.S. Cl.

CPC ..... *C11D 17/045* (2013.01); *C11D 1/22* (2013.01); *C11D 1/29* (2013.01); *C11D 1/66* (2013.01); *C11D 1/72* (2013.01); *C11D 1/83* (2013.01); *C11D 3/124* (2013.01); *C11D 3/126* (2013.01); *C11D 3/222* (2013.01); *C11D 3/323* (2013.01); *C11D 3/373* (2013.01); *C11D 3/3726* (2013.01); *C11D 3/3753* (2013.01); *C11D 3/3769* (2013.01); *C11D 3/50* (2013.01); *C11D 3/505* (2013.01); *C11D 7/20* (2013.01); *C11D 7/265* (2013.01); *C11D 17/0039* (2013.01); *C11D 17/042* (2013.01); *C11D 17/044* (2013.01)

(58) Field of Classification Search

CPC ..... C11D 3/505; C11D 9/44; C11D 17/042

See application file for complete search history.

(56) References Cited

U.S. PATENT DOCUMENTS

| | | | | |
|---|---|---|---|---|
| 4,652,392 | A * | 3/1987 | Baginski | C11D 3/0026 510/228 |
| 7,534,759 | B2 * | 5/2009 | Wahl | C11D 3/0015 510/439 |
| 7,867,968 | B1 * | 1/2011 | Aouad | C08K 7/22 510/296 |
| 8,367,599 | B2 * | 2/2013 | Pfeiffer | C11D 3/3765 510/223 |
| 9,347,022 | B1 * | 5/2016 | Frentzel | C11B 9/00 |
| 9,878,467 | B2 | 1/2018 | Huddleston et al. | |
| 2003/0045441 | A1 * | 3/2003 | Hsu | C11D 17/043 510/296 |
| 2005/0101501 | A1 * | 5/2005 | Aussant | C11D 3/50 510/296 |
| 2007/0105739 | A1 * | 5/2007 | Wahl | C11D 3/0015 510/295 |
| 2007/0135320 | A1 * | 6/2007 | Meli | C11D 3/505 510/101 |
| 2007/0249512 | A1 * | 10/2007 | Mort | C11D 3/40 510/445 |
| 2008/0226808 | A1 * | 9/2008 | Meli | C11D 3/042 426/650 |
| 2009/0239779 | A1 * | 9/2009 | Baston | C11D 3/222 510/302 |
| 2009/0320212 | A1 * | 12/2009 | Brown | C11D 1/65 8/137 |
| 2010/0192986 | A1 * | 8/2010 | Brooker | B65D 65/46 134/29 |

(Continued)

FOREIGN PATENT DOCUMENTS

EP 1 201 743 A 5/2002

OTHER PUBLICATIONS

European Search Report for Application No. 15200549.2—1358, dated Jun. 16, 2016, 6 pages.

*Primary Examiner* — Charles I Boyer

(74) *Attorney, Agent, or Firm* — Gregory S. Darley-Emerson

(57) ABSTRACT

A water-soluble unit dose article that includes a water-soluble film and at least a first internal compartment, where the first internal compartment includes one or more of a first particle, where the first particle comprises between about 45% and about 95% by weight of the first particle of a carrier material selected from polyethylene glycol, polyvinyl alcohol, urea, polyurethane, silica, alkoxylated fatty alcohols or mixtures thereof, between about 1% and about 50% by weight of the first particle of a benefit agent, and less than about 20% by weight of the first particle of a surfactant.

22 Claims, No Drawings

(56) References Cited

U.S. PATENT DOCUMENTS

| | | | | |
|---|---|---|---|---|
| 2010/0240570 | A1* | 9/2010 | Blyth | C11D 3/001<br>510/328 |
| 2011/0097369 | A1* | 4/2011 | Sunder | C11D 3/221<br>424/401 |
| 2012/0165239 | A1* | 6/2012 | Dreja | C11D 3/2079<br>510/299 |
| 2014/0179587 | A1* | 6/2014 | Brown | C11D 3/3707<br>510/349 |
| 2015/0021355 | A1* | 1/2015 | Lopez | B65D 25/36<br>222/1 |
| 2016/0122693 | A1* | 5/2016 | Sodd | C11D 3/50<br>512/4 |

* cited by examiner

WATER-SOLUBLE UNIT DOSE ARTICLE CONTAINING POLYETHYLENE GLYCOL PARTICLES

FIELD OF THE INVENTION

The present disclosure relates to water-soluble unit dose articles and their use.

BACKGROUND OF THE INVENTION

Water-soluble unit dose articles are recognized by consumers as both convenient and easy to use. Often it is preferred to formulate active materials in the form of powders as these provide improved stability of the actives and reduce instances of interaction between incompatible ingredients.

However, powders are susceptible to 'caking' in the presence of moisture in the environment. Caking refers to instance of the powder particles 'clumping' or adhering together in the presence of moisture. This 'caking' negatively affects the consumer aesthetics of the powder but also negatively affects the dissolution of the powder in the wash liquor. This caking effect is even more problematic in a water-soluble unit dose due to the caked powder sticking to the water-soluble film. This then furthers retards dissolution by affecting the dissolution profile of both the powder and film. Overall, the dissolution of the water-soluble pouch is negatively affected.

It was surprisingly found that by formulating the specific particles of the present invention into a water-soluble unit dose article, the tendency for moisture absorbance and hence caking was reduced and instances of poor dissolution were also reduced.

SUMMARY OF THE INVENTION

The present relates to a water-soluble unit dose article comprising a water-soluble film and at least a first internal compartment, wherein the internal compartment comprises one or more of a first particle, wherein the first particle comprises between 45% and 95% by weight of the first particle of a carrier material selected from polyethylene glycol, polyvinyl alcohol, urea, polyurethane, silica, alkoxylated fatty alcohols or mixtures thereof, between 1% and 50% by weight of the first particle of a benefit agent and less than 20% by weight of the first particle of a surfactant.

DETAILED DESCRIPTION OF THE INVENTION

Water-Soluble Unit Dose Article

The present disclosure relates to a water-soluble unit dose article comprising a water-soluble film and at least a first internal compartment, wherein the internal compartment comprises one or more of a first particle, wherein the first particle comprises between 45% and 95% by weight of the first particle of a carrier material selected from polyethylene glycol, polyvinyl alcohol, urea, polyurethane, silica or mixtures thereof, between 1% and 50% by weight of the first particle of a benefit agent and less than 20% by weight of the first particle of a surfactant.

The water-soluble unit dose article comprises at least one water-soluble film shaped such that the unit-dose article comprises at least one internal compartment surrounded by the water-soluble film. The at least one compartment comprises the first particle. The water-soluble film is sealed such that the first particle does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the particle. Preferably, the unit dose article comprises a water-soluble film. The unit dose article is manufactured such that the water-soluble film completely surrounds the particle and in doing so defines the compartment in which the particle resides. The unit dose article may comprise two films. A first film may be shaped to comprise an open compartment into which the particle is added. A second film is then laid over the first film in such an orientation as to close the opening of the compartment. The first and second films are then sealed together along a seal region. The film is described in more detail below.

The unit dose article may comprise more than one compartment, even at least two compartments, or even at least three compartments. The compartments may be arranged in superposed orientation, i.e. one positioned on top of the other. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment, but does not completely enclose the second compartment. Alternatively one compartment may be completely enclosed within another compartment.

Wherein the unit dose article comprises at least two compartments, one of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the first particle according to the present invention may be comprised in at least one of the compartments. It may for example be comprised in just one compartment, or may be comprised in two compartments, or even in three compartments.

Each compartment may comprise the same or different compositions. The different compositions could all be in the same form, or they may be in different forms, for example one or more may be liquid and one or more may be the particle.

The water-soluble unit dose article comprises a first particle which is described in more detail below.

The water-soluble unit dose article comprises a water-soluble film. Water-soluble films are described in more detail below.

The unit dose article may comprise at least a first and a second compartment and wherein the second compartment comprises a liquid composition. Preferably the liquid composition comprises a surfactant. The liquid composition is described in more detail below.

The unit dose article may comprise at least a first and a second compartment and wherein the second compartment comprises a second particle. Preferably, the second particle comprises greater than 20% by weight of the second particle of a surfactant. The surfactant is preferably selected from anionic surfactants, non-ionic surfactants, cationic surfactants or a mixture thereof, preferably the surfactant is an anionic surfactant.

Wherein the unit dose article comprises a first and second compartment, the first and second compartments are preferably arranged in a side-by-side orientation or are superposed onto one another.

The water-soluble unit dose article may comprise an air bubble.

The water-soluble unit dose article may be transparent, translucent or opaque.

The water-soluble unit dose article may comprise an aversive agent. The aversive agent may be comprised within the water-soluble film, on the outside of the unit dose article, in the first composition, in the second composition or a mixture thereof. Suitable aversive agents are described below.

First Particle

The first particle comprises between 45% and 95% by weight of the first particle of a carrier material, between 1% and 50% by weight of the first particle of a benefit agent and less than 20% by weight of the first particle of a surfactant.

The first particle may comprise between 5% and 50%, preferably between 10% and 40% by weight of the first particle of a benefit agent. The benefit agent is described in more detail below.

The first particle may comprise between 50% and 90%, preferably between 65% and 85% by weight of the first particle of a carrier material. The carrier material is described in more detail below.

The benefit agent may be comprised within the first particle, may be coated on the outside of the first particle or a mixture thereof. The first particle may be dusted with the benefit agent. Alternatively, the benefit agent may be comprised within the matrix of the first particle. For example, the first particle may comprise an absorbent carrier and the benefit agent is absorbed into said carrier.

The first particle comprises less than 20%, preferably less than 15%, more preferably less than 10% by weight of the first particle of a surfactant. The surfactant may be selected from anionic surfactants, non-ionic surfactants, cationic surfactants or a mixture thereof, preferably the surfactant is an anionic surfactant.

The unit dose article may comprise between 5% and 80%, preferably between 10% and 70%, more preferably between 15% and 60% by weight of the unit dose article of the first particle.

Preferably, the first particle preferably has a mean particle size of between 0.5 mm and 5 mm, preferably between 0.5 mm and 3 mm, more preferably between 0.5 mm and 1.5 mm. Those skilled in the art will know how to measure the mean particle size using standard techniques. An exemplary method is ASTM Standard technique D502-89.

Benefit Agent

The first particle comprises between 1% and 50%, preferably between 5% and 50%, more preferably between 10% and 40% by weight of the first particle of a benefit agent.

The benefit agent may be a laundry benefit agent. The benefit agent may be selected from cleaning agents, softening agents, freshness agents, malodour agents, whiteness agents, dye transfer inhibition agents or mixtures thereof.

Preferably, the benefit agent is selected from perfumes, perfume microcapsules, cationic polymers, silicones, bleach, enzymes, hueing dyes, dye fixatives, dye transfer inhibitors, soil release polymers, antimicrobials and mixtures thereof, preferably selected from the group comprising perfume, encapsulated perfumes, silicones, cellulosic polymers, metathesized unsaturated polyol esters, silane-modified oils and mixtures thereof.

The benefit agent may be a freshness active selected from perfumes, encapsulated perfume, and mixtures thereof.

The benefit agent may be a softening active selected from the group comprising silicones, cellulosic polymers and mixtures thereof.

Perfume

Any suitable perfume may be used. Perfumes usually comprise different mixtures of perfume raw materials. The type and quantity of perfume raw material dictates the olfactory character of the perfume.

The perfume may comprise a perfume raw material selected from the group consisting of perfume raw materials having a boiling point (B.P.) lower than about 250° C. and a ClogP lower than about 3, perfume raw materials having a B.P. of greater than about 250° C. and a ClogP of greater than about 3, perfume raw materials having a B.P. of greater than about 250° C. and a ClogP lower than about 3, perfume raw materials having a B.P. lower than about 250° C. and a ClogP greater than about 3 and mixtures thereof. Perfume raw materials having a boiling point B.P. lower than about 250° C. and a ClogP lower than about 3 are known as Quadrant I perfume raw materials. Quadrant 1 perfume raw materials are preferably limited to less than 30% of the perfume comprosition. Perfume raw materials having a B.P. of greater than about 250° C. and a ClogP of greater than about 3 are known as Quadrant IV perfume raw materials, perfume raw materials having a B.P. of greater than about 250° C. and a ClogP lower than about 3 are known as Quadrant II perfume raw materials, perfume raw materials having a B.P. lower than about 250° C. and a ClogP greater than about 3 are known as a Quadrant III perfume raw materials. Suitable Quadrant I, II, III and IV perfume raw materials are disclosed in U.S. Pat. No. 6,869,923 B1.

Preferred perfume raw material classes include ketones and aldehydes. Those skilled in the art will know how to formulate an appropriate perfume.

Encapsulated Perfume

Any suitable encapsulated perfume may be used. Preferred encapsulated perfumes are perfume microcapsules, preferably of the core-and-shell architecture. Such perfume microcapsules comprise an outer shell defining an inner space in which the perfume is held until rupture of the perfume microcapsule during use of the fabrics by the consumer.

The microcapsule preferably comprises a core material and a wall material that at least partially surrounds said core, wherein said core comprises the perfume.

In one aspect, at least 75%, 85% or even 90% of said microcapsules may have a particle size of from about 1 microns to about 80 microns, about 5 microns to 60 microns, from about 10 microns to about 50 microns, or even from about 15 microns to about 40 microns. In another aspect, at least 75%, 85% or even 90% of said microcapsules may have a particle wall thickness of from about 60 nm to about 250 nm, from about 80 nm to about 180 nm, or even from about 100 nm to about 160 nm.

In one aspect, said perfume delivery technology may comprise microcapsules formed by at least partially surrounding a benefit agent with a wall material. Said benefit agent may include materials selected from the group consisting of perfumes such as 3-(4-t-butylphenyl)-2-methyl propanal, 3-(4-t-butylphenyl)-propanal, 3-(4-isopropylphenyl)-2-methylpropanal, 3-(3,4-methylenedioxyphenyl)-2-methylpropanal, and 2,6-dimethyl-5-heptenal, α-damascone, β-damascone, δ-damascone, β-damascenone, 6,7-dihydro-1,1,2,3,3-pentamethyl-4(5H)-indanone, methyl-7,3-dihydro-2H-1,5-benzodioxepine-3-one, 2-[2-(4-methyl-3-cyclohexenyl-1-yl)propyl]cyclopentan-2-one, 2-sec-butylcyclohexanone, and β-dihydro ionone, linalool, ethyllinalool, tetrahydrolinalool, and dihydromyrcenol; silicone oils, waxes such as polyethylene waxes; essential oils such as fish oils, jasmine, camphor, lavender; skin coolants such as menthol, methyl lactate; vitamins such as Vitamin A and E; sunscreens; glycerine; catalysts such as manganese catalysts or bleach catalysts; bleach particles such as perborates; silicon dioxide particles; antiperspirant actives; cationic polymers and mixtures thereof. Suitable benefit agents can be obtained from Givaudan Corp. of Mount Olive, N.J., USA, International Flavors & Fragrances Corp. of South Brunswick, N.J., USA, or Quest Corp. of Naarden, Netherlands. In one aspect, the microcapsule wall material may comprise: melamine, polyacrylamide, silicones, silica, polystyrene, polyurea, polyurethanes, polyacrylate based materials, polyacrylate esters based materials, gelatin, styrene malic anhydride, polyamides, aromatic alcohols, polyvinyl alcohol and mixtures thereof. In one aspect, said melamine wall material may comprise melamine crosslinked with formaldehyde, melamine-dimethoxyethanol crosslinked with formaldehyde, and mixtures thereof. In one aspect, said polystyrene wall material may comprise polyestyrene cross-linked with divinylbenzene. In one aspect, said polyurea wall material may comprise urea crosslinked with formaldehyde, urea crosslinked with gluteraldehyde, and mixtures thereof. In one aspect, said polyacrylate based wall materials may comprise polyacrylate formed from methylmethacrylate/dimethylaminomethyl methacrylate, polyacrylate formed from amine acrylate and/or methacrylate and strong acid, polyacrylate formed from carboxylic acid acrylate and/or methacrylate monomer and strong base, polyacrylate formed from an amine acrylate and/or methacrylate monomer and a carboxylic acid acrylate and/or carboxylic acid methacrylate monomer, and mixtures thereof.

In one aspect, said polyacrylate ester based wall materials may comprise polyacrylate esters formed by alkyl and/or glycidyl esters of acrylic acid and/or methacrylic acid, acrylic acid esters and/or methacrylic acid esters which carry hydroxyl and/or carboxy groups, and allylgluconamide, and mixtures thereof.

In one aspect, said aromatic alcohol based wall material may comprise aryloxyalkanols, arylalkanols and oligoalkanolarylethers. It may also comprise aromatic compounds with at least one free hydroxyl-group, especially preferred at least two free hydroxy groups that are directly aromatically coupled, wherein it is especially preferred if at least two free hydroxy-groups are coupled directly to an aromatic ring, and more especially preferred, positioned relative to each other in meta position. It is preferred that the aromatic alcohols are selected from phenols, cresoles (o-, m-, and p-cresol), naphthols (alpha and beta-naphthol) and thymol, as well as ethylphenols, propylphenols, fluorphenols and methoxyphenols.

In one aspect, said polyurea based wall material may comprise a polyisocyanate. In some embodiments, the polyisocyanate is an aromatic polyisocyanate containing a phenyl, a toluoyl, a xylyl, a naphthyl or a diphenyl moiety (e.g., a polyisocyanurate of toluene diisocyanate, a trimethylol propane-adduct of toluene diisocyanate or a trimethylol propane-adduct of xylylene diisocyanate), an aliphatic polyisocyanate (e.g., a trimer of hexamethylene diisocyanate, a trimer of isophorone diisocyanate and a biuret of hexamethylene diisocyanate), or a mixture thereof (e.g., a mixture of a biuret of hexamethylene diisocyanate and a trimethylol propane-adduct of xylylene diisocyanate). In still other embodiments, the polyisocyante may be cosslinked the cross-linking agent being a polyamine (e.g., diethylenetriamine, bis(3-aminopropyl)amine, bis(hexanethylene)triamine, tris(2-aminoethyl)amine, triethylenetetramine, N,N'-bis(3-aminopropyl)-1,3-propanediamine, tetraethylenepentamine, pentaethylenehexamine, branched polyethylenimine, chitosan, nisin, gelatin, 1,3-diaminoguanidine monohydrochloride, 1,1-dimethylbiguanide hydrochloride, or guanidine carbonate).

In one aspect, said polyvinyl alcohol based wall material may comprise a crosslinked, hydrophobically modified polyvinyl alcohol, which comprises a crosslinking agent comprising i) a first dextran aldehyde having a molecular weight of from 2,000 to 50,000 Da; and ii) a second dextran aldehyde having a molecular weight of from greater than 50,000 to 2,000,000 Da.

In one aspect, the perfume microcapsule may be coated with a deposition aid, a cationic polymer, a non-ionic polymer, an anionic polymer, or mixtures thereof. Suitable polymers may be selected from the group consisting of: polyvinylformaldehyde, partially hydroxylated polyvinylformaldehyde, polyvinylamine, polyethyleneimine, ethoxylated polyethyleneimine, polyvinylalcohol, polyacrylates, and combinations thereof. Suitable deposition aids are described above and in the section titled "Deposition Aid". In one aspect, the microcapsule may be a perfume microcapsule. In one aspect, one or more types of microcapsules, for examples two microcapsules types, wherein one of the first or second microcapsules (a) has a wall made of a different wall material than the other; (b) has a wall that includes a different amount of wall material or monomer than the other; or (c) contains a different amount perfume oil ingredient than the other.; or (d) contains a different perfume oil, may be used.

Cellulosic Polymer

The cellulosic polymer may be selected from alkyl cellulose, alkyl alkoxyalkyl cellulose, carboxyalkyl cellulose, alkyl carboxyalkyl, hydroxyethyl cellulose and any combination thereof. The cellulosic polymer may be selected from carboxymethyl cellulose, methyl cellulose, methyl hydroxyethyl cellulose, methyl carboxymethyl cellulose, hydrophobically modified hydroxyethyl cellulose and mixtures thereof.

The cellulosic polymer may comprise a carboxymethyl cellulose. The carboxymethyl cellulose may have a degree of carboxymethyl substitution from 0.5 to 0.9 and a molecular weight from 100,000 Da to 300,000 Da.

The carboxymethyl cellulose may have a degree of substitution (DS) of from 0.01 to 0.99 and a degree of blockiness (DB) such that either DS+DB is of at least 1.00 or $DB+2DS-DS^2$ is at least 1.20. The substituted carboxymethyl cellulose can have a degree of substitution (DS) of at least 0.55. The carboxymethyl cellulose can have a degree of blockiness (DB) of at least 0.35. The substituted cellulosic polymer can have a DS+DB, of from 1.05 to 2.00.

The cellulosic polymer may comprise a hydroxyethylcellulose.

The hydroxyethylcellulose may comprise a hydrophobically modified hydroxyethylcellulose. By 'hydrophobically modified', we herein mean that one or more hydrophobic groups are bound to the polymer backbone. The hydrophobic group may be bound to the polymer backbone via an alkylene group, preferably a $C_{1-6}$ alkylene group.

Preferably, the hydrophobic group is selected from linear or branched alkyl groups, aromatic groups, polyether groups, or a mixture thereof.

The hydrophobic group may comprise an alkyl group. The alkyl group may have a chain length of between $C_8$ and $C_{50}$, preferably between $C_8$ and $C_{26}$, more preferably between $C_{12}$ and $C_{22}$, most preferably between $C_{16}$ and $C_{20}$.

The hydrophobic group may comprise a polyalkylene glycol, preferably wherein the polalkylene glycol is selected from polyethylene glycol, polypropylene glycol, or a mixture thereof. The polyethylene glycol may comprise a copolymer comprising oxyethylene and oxypropylene units. The copolymer may comprise between 2 and 30 repeating units, wherein the terminal hydroxyl group of the polyalkylene glycol is preferably esterified or etherized. Preferably, the ester bond is formed with an acid selected from a $C_{5-50}$ carboxylic acid, preferably $C_{8-26}$ carboxylic acid, more preferably $C_{16-20}$ carboxylic acid, and wherein the ether bond is preferably formed with a $C_{5-50}$ alcohol, more preferably $C_{8-26}$ alcohol, most preferably a $C_{16-20}$ alcohol.

The hydroxyethyl cellulose may be derivatised with trimethyl ammonium substituted epoxide. The polymer may have a molecular weight of between 100,000 and 800,000 daltons.

The hydroxyethyl cellulose may have repeating substituted anhydroglucose units that correspond to the general Structural Formula I as follows:

Structural Formula I

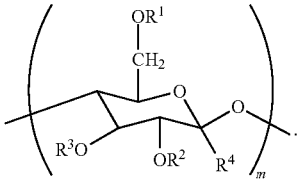

wherein:

a. m is an integer from 20 to 10,000 b. Each R4 is H, and $R^1$, $R^2$, $R^3$ are each independently selected from the group consisting of: H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl or $C_6$-$C_{32}$ alkylaryl, or $C_6$-$C_{32}$ substituted alkylaryl, and

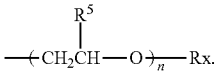

Preferably, $R^1$, $R^2$, $R^3$ are each independently selected from the group consisting of: H; $C_1$-$C_4$ alkyl;

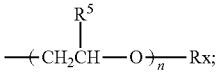

and mixtures thereof;

wherein:

n is an integer selected from 0 to 10 and

Rx is selected from the group consisting of: H;

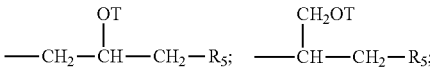

-continued

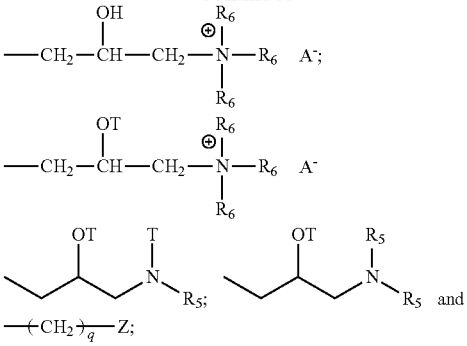

preferably Rx has a structure selected from the group consisting of: H;

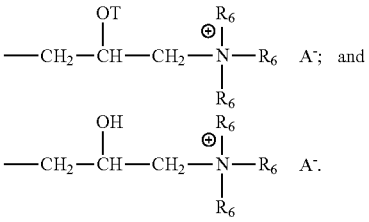

wherein $A^-$ is a suitable anion. Preferably, $A^-$ is selected from the group consisting of: $Cl^-$, $Br^-$, $I^-$, methylsulfate, ethylsulfate, toluene sulfonate, carboxylate, and phosphate;

Z is selected from the group consisting of carboxylate, phosphate, phosphonate, and sulfate.

q is an integer selected from 1 to 4;

each $R_5$ is independently selected from the group consisting of: H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, and OH. Preferably, each $R_5$ is selected from the group consisting of: H, $C_1$-$C_{32}$ alkyl, and $C_1$-$C_{32}$ substituted alkyl. More preferably, $R_5$ is selected from the group consisting of H, methyl, and ethyl.

Each $R_6$ is independently selected from the group consisting of: H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted alkylaryl. Preferably, each $R_6$ is selected from the group consisting of: H, $C_1$-$C_{32}$ alkyl, and $C_1$-$C_{32}$ substituted alkyl.

Each T is independently selected from the group: H,

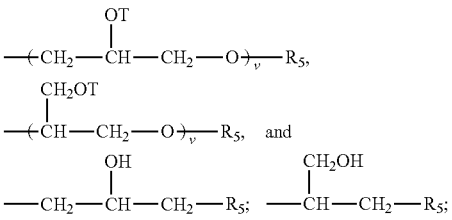

wherein each v in said polysaccharide is an integer from 1 to 10. Preferably, v is an integer from 1 to 5. The sum of all v indices in each Rx in said polysaccharide is an integer from 1 to 30, more preferably from 1 to 20, even more preferably from 1 to 10. In the last

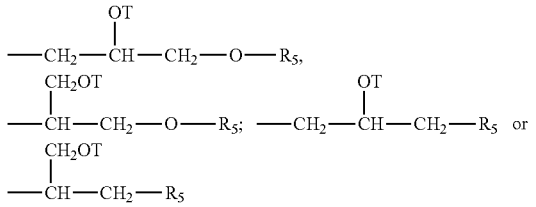

group in a chain, T is always an H.

Alkyl substitution on the anhydroglucose rings of the polymer may range from 0.01% to 5% per glucose unit, more preferably from 0.05% to 2% per glucose unit, of the polymeric material.

The hydroxyethylcellulose may be lightly cross-linked with a dialdehyde, such as glyoxal, to prevent forming lumps, nodules or other agglomerations when added to water at ambient temperatures.

The polymers of Structural Formula I likewise include those which are commercially available and further include materials which can be prepared by conventional chemical modification of commercially available materials. Commercially available cellulose polymers of the Structural Formula I type include those with the INCI name Polyquaternium 10, such as those sold under the trade names: Ucare Polymer JR 30M, JR 400, JR 125, LR 400 and LK 400 polymers; Polyquaternium 67 such as those sold under the trade name Softcat SK™, all of which are marketed by Amerchol Corporation, Edgewater N.J.; and Polyquaternium 4 such as those sold under the trade name: Celquat H200 and Celquat L-200, available from National Starch and Chemical Company, Bridgewater, N.J. Other suitable polysaccharides include hydroxyethyl cellulose or hydoxypropylcellulose quaternized with glycidyl $C_{12}$-$C_{22}$ alkyl dimethyl ammonium chloride. Examples of such polysaccharides include the polymers with the INCI names Polyquaternium 24 such as those sold under the trade name Quaternium LM 200 by Amerchol Corporation, Edgewater N.J.

Silicone

A preferred silicone is a polydialkylsilicone, alternatively a polydimethyl silicone (polydimethyl siloxane or "PDMS"), or a derivative thereof. Preferably, the silicone has a viscosity at a temperature of 25° C. and a shear rate of $1000s^{-1}$ in the range of from 1 Pa s to 100 Pa s. Without wishing to be bound by theory, increasing the viscosity of the silicone improves the deposition of the perfume onto the treated surface. However, without wishing to be bound by theory, if the viscosity is too high, it is difficult to process and form the benefit delivery composition. A preferred silicone is AK 60000 from Wacker, Munich, Germany.

Other suitable silicones are selected from an aminofunctional silicone, amino-polyether silicone, alkyloxylated silicone, cationic silicone, ethoxylated silicone, propoxylated silicone, ethoxylated/propoxylated silicone, quaternary silicone, anionic silicone or combinations thereof. Suitable silicones are selected from random or blocky organosilicone polymers having the following formula:

$$[R_1R_2R_3SiO_{1/2}]_{(j+2)}[R_4Si(X—Z)O_{2/2}]_k[R_4R_4SiO_{2/2}]_m[R_4SiO_{3/2}]_j$$

wherein:

j is an integer from 0 to about 98; in one aspect j is an integer from 0 to about 48; in one aspect, j is 0;

k is an integer from 0 to about 200, in one aspect k is an integer from 0 to about 50; when k=0, at least one of $R_1$ $R_2$ or $R_3$ is —X—Z;

m is an integer from 4 to about 5,000; in one aspect m is an integer from about 10 to about 4,000; in another aspect m is an integer from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—Z;

each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

each X in said alkyl siloxane polymer comprises a substituted or unsubsitituted divalent alkylene radical comprising 2-12 carbon atoms, in one aspect each divalent alkylene radical is independently selected from the group consisting of —$(CH_2)_s$— wherein s is an integer from about 2 to about 8, from about 2 to about 4; in one aspect, each X in said alkyl siloxane polymer comprises a substituted divalent alkylene radical selected from the group consisting of: —$CH_2$—CH(OH)—$CH_2$—; —$CH_2$—$CH_2$—CH(OH)—; and

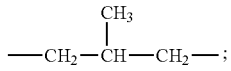

each Z is selected independently from the group consisting of

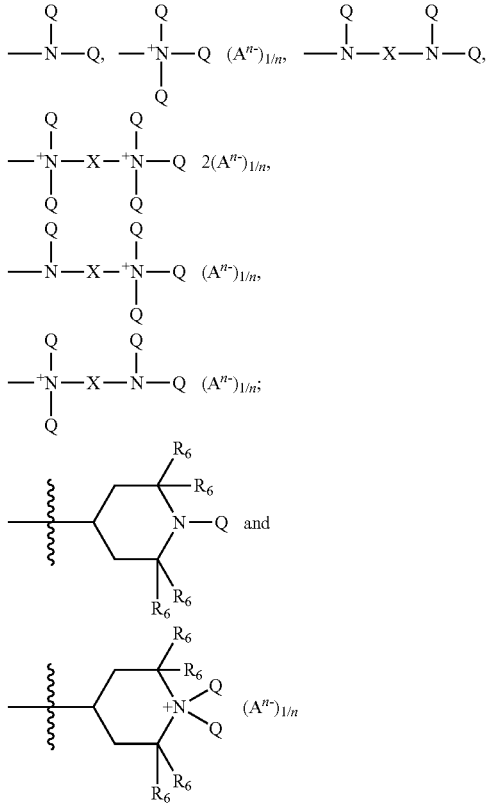

with the proviso that when Z is a quat, Q cannot be an amide, imine, or urea moiety and if Q is an amide, imine, or urea moiety, then any additional Q bonded to the same nitrogen as said amide, imine, or urea moiety must be H or a $C_1$-$C_6$ alkyl, in one aspect, said additional Q is H; for Z $A^{n-}$ is a suitable charge balancing anion. In one aspect $A^{n-}$ is selected from the group consisting of $Cl^-$, $Br^-$, $I^-$, methylsulfate, toluene sulfonate, carboxylate and phosphate; and at least one Q in said organosilicone is independently selected from —$CH_2$—CH(OH)—$CH_2$—$R_5$;

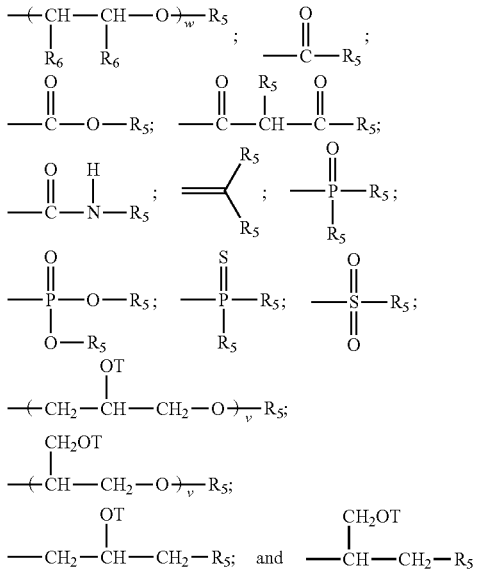

each additional Q in said organosilicone is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$CH_2$—CH(OH)—$CH_2$—$R_5$;

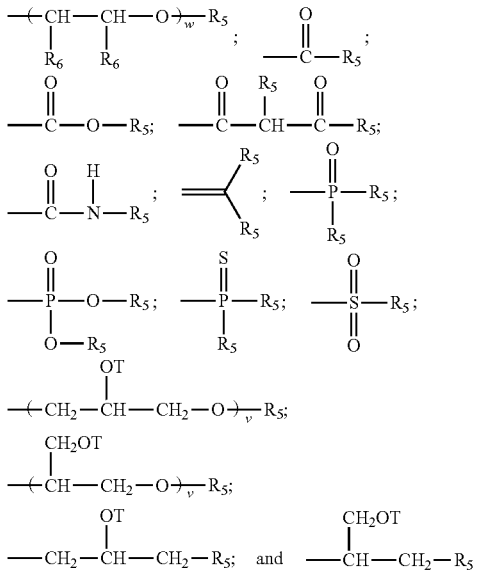

wherein each $R_5$ is independently selected from the group consisting of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$(CHR_6$—$CHR_6$—O—$)_w$—L and a siloxyl residue;

each $R_6$ is independently selected from H, $C_1$-$C_{18}$ alkyl each L is independently selected from —C(O)—$R_7$ or $R_7$;

w is an integer from 0 to about 500, in one aspect w is an integer from about 1 to about 200; in one aspect w is an integer from about 1 to about 50;

each $R_7$ is selected independently from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl; $C_6$-$C_{32}$ substituted alkylaryl and a siloxyl residue;

each T is independently selected from H, and

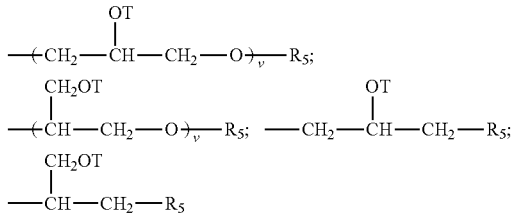

and wherein each v in said organosilicone is an integer from 1 to about 10, in one aspect, v is an integer from 1 to about 5 and the sum of all v indices in each Q in the said organosilicone is an integer from 1 to about 30 or from 1 to about 20 or even from 1 to about 10.

In another embodiment, the silicone may be chosen from a random or blocky organosilicone polymer having the following formula:

$$[R_1R_2R_3SiO_{1/2}]_{(j+2)}[R_4Si(X—Z)O_{2/2}]_k[R_4R_4SiO_{2/2}]_m[R_4SiO_{3/2}]_j$$

wherein j is an integer from 0 to about 98; in one aspect j is an integer from 0 to about 48; in one aspect, j is 0;

k is an integer from 0 to about 200; when k=0, at least one of $R_1$, $R_2$ or $R_3$=—X—Z, in one aspect, k is an integer from 0 to about 50 m is an integer from 4 to about 5,000; in one aspect m is an integer from about 10 to about 4,000; in another aspect m is an integer from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—Z;

each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

each X comprises of a substituted or unsubstituted divalent alkylene radical comprising 2-12 carbon atoms; in one aspect each X is independently selected from the group consisting of —$(CH_2)_s$—O—; —$CH_2$—CH(OH)—$CH_2$—O—;

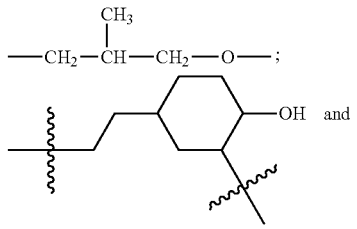

-continued

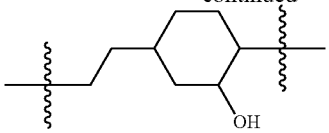

wherein each s independently is an integer from about 2 to about 8, in one aspect s is an integer from about 2 to about 4;

At least one Z in the said organosiloxane is selected from the group consisting of $R_5$;

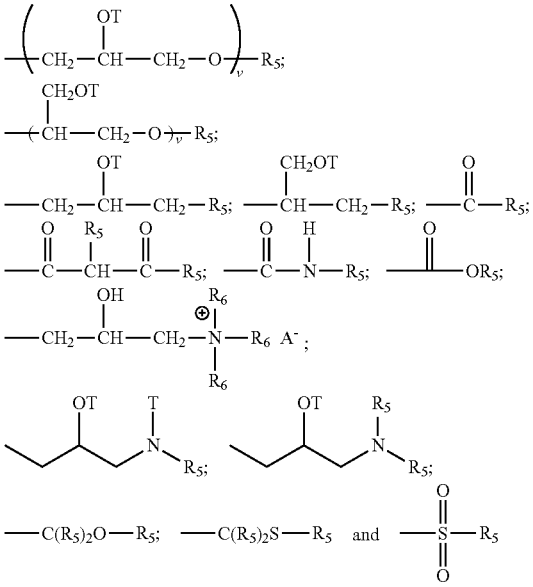

provided that when X is

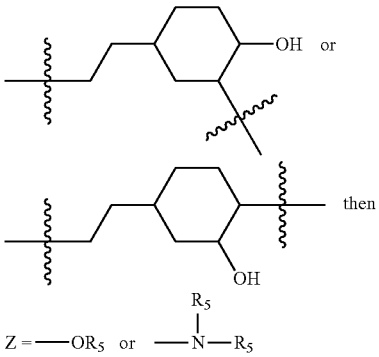

wherein $A^-$ is a suitable charge balancing anion. In one aspect $A^-$ is selected from the group consisting of $Cl^-$, $Br^-$, $I^-$, methylsulfate, toluene sulfonate, carboxylate and phosphate and each additional Z in said organosilicone is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $R_5$,

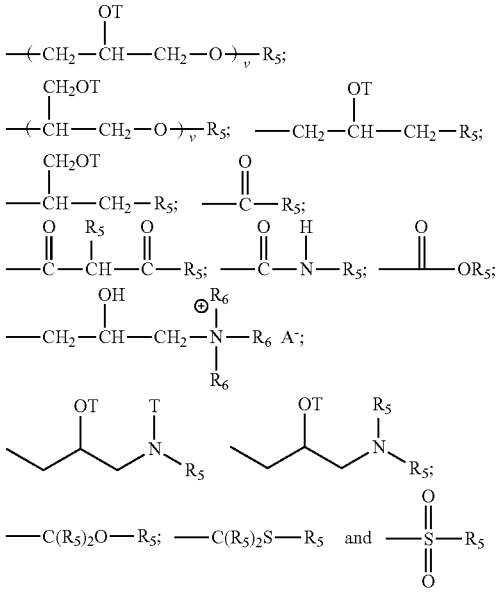

provided that when X is

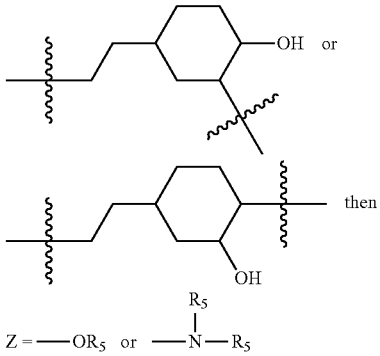

each $R_5$ is independently selected from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl or $C_6$-$C_{32}$ alkylaryl, or $C_6$-$C_{32}$ substituted alkylaryl, $—(CHR_6—CHR_6—O—)_w—CHR_6—CHR_6—L$ and siloxyl residue wherein each L is independently selected from $—O—C(O)—R_7$ or $—O—R_7$;

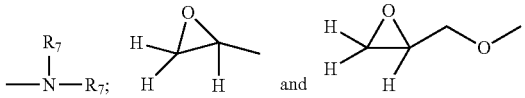

w is an integer from 0 to about 500, in one aspect w is an integer from 0 to about 200, one aspect w is an integer from 0 to about 50;

each $R_6$ is independently selected from H or $C_1$-$C_{18}$ alkyl;

each $R_7$ is independently selected from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted aryl, and a siloxyl residue: each T is independently selected from H;

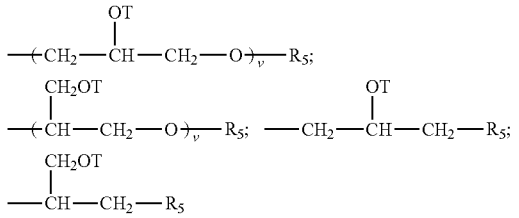

wherein each v in said organosilicone is an integer from 1 to about 10, in one aspect, v is an integer from 1 to about 5 and the sum of all v indices in each Z in the said organosilicone is an integer from 1 to about 30 or from 1 to about 20 or even from 1 to about 10.

A suitable silicone is a blocky cationic organopolysiloxane having the formula:

$$M_wD_xT_yQ_z$$

wherein:

M=[$SiR_1R_2R_3O_{1/2}$], [$SiR_1R_2G_1O_{1/2}$], [$SiR_1G_1G_2O_{1/2}$], [$SiG_1G_2G_3O_{1/2}$], or combinations thereof;

D=[$SiR_1R_2O_{2/2}$], [$SiR_1G_1O_{2/2}$], [$SiG_1G_2O_{2/2}$] or combinations thereof;

T=[$SiR_1O_{3/2}$], [$SiG_1O_{3/2}$] or combinations thereof;

Q=[$SiO_{4/2}$];

w=is an integer from 1 to (2+y+2z);

x=is an integer from 5 to 15,000;

y=is an integer from 0 to 98;

z=is an integer from 0 to 98;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy, $C_1$-$C_{32}$ alkylamino, and $C_1$-$C_{32}$ substituted alkylamino;

at least one of M, D, or T incorporates at least one moiety $G_1$, $G_2$ or $G_3$, and $G_1$, $G_2$, and $G_3$ are each independently selected from the formula:

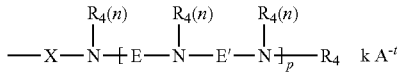

wherein:

X comprises a divalent radical selected from the group consisting of $C_1$-$C_{32}$ alkylene, $C_1$-$C_{32}$ substituted alkylene, $C_5$-$C_{32}$ or $C_6$-$C_{32}$ arylene, $C_5$-$C_{32}$ or $C_6$-$C_{32}$ substituted arylene, $C_6$-$C_{32}$ arylalkylene, $C_6$-$C_{32}$ substituted arylalkylene, $C_1$-$C_{32}$ alkoxy, $C_1$-$C_{32}$ substituted alkoxy, $C_1$-$C_{32}$ alkyleneamino, $C_1$-$C_{32}$ substituted alkyleneamino, ring-opened epoxide, and ring-opened glycidyl, with the proviso that if X does not comprise a repeating alkylene oxide moiety then X can further comprise a heteroatom selected from the group consisting of P, N and O;

each $R_4$ comprises identical or different monovalent radicals selected from the group consisting of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted alkylaryl;

E comprises a divalent radical selected from the group consisting of $C_1$-$C_{32}$ alkylene, $C_1$-$C_{32}$ substituted alkylene, $C_5$-$C_{32}$ or $C_6$-$C_{32}$ arylene, $C_5$-$C_{32}$ or $C_6$-$C_{32}$ substituted arylene, $C_6$-$C_{32}$ arylalkylene, $C_6$-$C_{32}$ substituted arylalkylene, $C_1$-$C_{32}$ alkoxy, $C_1$-$C_{32}$ substituted alkoxy, $C_1$-$C_{32}$ alkyleneamino, $C_1$-$C_{32}$ substituted alkyleneamino, ring-opened epoxide and ring-opened glycidyl, with the proviso that if E does not comprise a repeating alkylene oxide moiety then E can further comprise a heteroatom selected from the group consisting of P, N, and O;

E' comprises a divalent radical selected from the group consisting of $C_1$-$C_{32}$ alkylene, $C_1$-$C_{32}$ substituted alkylene, $C_5$-$C_{32}$ or $C_6$-$C_{32}$ arylene, $C_5$-$C_{32}$ or $C_6$-$C_{32}$ substituted arylene, $C_6$-$C_{32}$ arylalkylene, $C_6$-$C_{32}$ substituted arylalkylene, $C_1$-$C_{32}$ alkoxy, $C_1$-$C_{32}$ substituted alkoxy, $C_1$-$C_{32}$ alkyleneamino, $C_1$-$C_{32}$ substituted alkyleneamino, ring-opened epoxide and ring-opened glycidyl, with the proviso that if E' does not comprise a repeating alkylene oxide moiety then E' can further comprise a heteroatom selected from the group consisting of P, N, and O;

p is an integer independently selected from 1 to 50;

n is an integer independently selected from 1 or 2;

when at least one of $G_1$, $G_2$, or $G_3$ is positively charged, $A^{-t}$ is a suitable charge balancing anion or anions such that the total charge, k, of the charge-balancing anion or anions is equal to and opposite from the net charge on the moiety $G_1$, $G_2$ or $G_3$, wherein t is an integer independently selected from 1, 2, or 3; and $k \leq (p*2/t)+1$; such that the total number of cationic charges balances the total number of anionic charges in the organopolysiloxane molecule; and wherein at least one E does not comprise an ethylene moiety.

Metathesized Unsaturated Polyol Ester

Metathesized unsaturated polyol ester refers to the product obtained when one or more unsaturated polyol ester ingredient(s) are subjected to a metathesis reaction. Metathesis is a catalytic reaction that involves the interchange of alkylidene units among compounds containing one or more double bonds (i.e., olefinic compounds) via the formation and cleavage of the carbon-carbon double bonds. Metathesis may occur between two of the same molecules (often referred to as self-metathesis) and/or it may occur between two different molecules (often referred to as cross-metathesis).

Silane-Modified Oils

In general, suitable silane-modified oils comprise a hydrocarbon chain selected from the group consisting of saturated oil, unsaturated oil, and mixtures thereof; and a hydrolysable silyl group covalently bonded to the hydrocarbon chain.

Carrier Material

The first particle comprises between 45% and 95%, preferably between 50% and 90%, more preferably between 65% and 85% by weight of the first particle of a carrier material. The carrier may be selected from polyethylene glycol, polyvinyl alcohol, urea, polyurethane, silica, alkoxylated fatty alcohols or mixtures thereof.

The carrier may be polyethylene glycol, preferably wherein the first particle comprises between 45% and 95%, preferably between 50% and 90%, more preferably between 65% and 85% by weight of the first particle of polyethylene glycol.

Preferably, the polyethylene glycol has a molecular weight of between 1000 daltons and 12,000 daltons, preferably between 6000 daltons and 10,000 daltons. The molecular weight of the polyethylene glycol maybe 1000 daltons, 2000 daltons, 3000 daltons, 4000 daltons, 5000 daltons, 6000 daltons, 7000 daltons, 8000 daltons, 9000 daltons or a mixture thereof.

The polyethylene glycol may comprise a copolymer of polyethylene glycol. The copolymer may be a polyethylene glycol/polypropylene glycol copolymer. Preferably, the copolymer has a molecular weight higher than 8000 daltons, preferably higher than 10,000 daltons.

The alkoxylated fatty alcohol may comprise ethoxylated fatty alcohols. Preferably, the ethoxylated fatty alcohol comprises a chain length of higher than C9 and a degree of ethoxylation higher than 6. More preferably, the ethoxylated fatty alcohol comprises a C12-18 fatty alcohol with a degree of ethoxylation higher than 25, preferably higher than 50, even more preferably higher than 70.

Liquid Composition

The water-soluble unit dose article may comprise at least a first and a second compartment. Preferably, the second compartment comprises a liquid composition and preferably the liquid composition comprises a surfactant. The surfactant is preferably selected from anionic surfactants, non-ionic surfactants, cationic surfactants or a mixture thereof, preferably the surfactant is an anionic surfactant. The anionic surfactant may be selected from alkyl alkoxylated surfactants, linear alkylbenzene sulphonate and mixtures thereof. The non-ionic surfactant may be selected from alkoxylated fatty alcohols, oxo-synthesised non-ionic surfactants, Guerbet alcohol non-ionic surfactants, glycereth cocoate, alkyl polyglucoside or a mixture thereof.

Second Particle

The unit dose article may comprise at least a first and a second compartment and wherein the second compartment comprises a second particle and wherein the second particle comprises greater than 20% by weight of the second particle of a surfactant. The surfactant is preferably selected from anionic surfactants, non-ionic surfactants, cationic surfactants or a mixture thereof, preferably the surfactant is an anionic surfactant. The anionic surfactant may be selected from alkyl alkoxylated surfactants, linear alkylbenzene sulphonate and mixtures thereof. The non-ionic surfactant may be selected from alkoxylated fatty alcohols, oxo-synthesised non-ionic surfactants, Guerbet alcohol non-ionic surfactants or a mixture thereof.

Aversive Agent

As used herein, an aversive agent is an agent that is intended to discourage ingestion and/or consumption of the unit dose articles described herein or components thereof, such as water-soluble films. An aversive agent may act by providing an unpleasant sensation, such as an unpleasant taste, when placed in the mouth or ingested. Such unpleasant sensations may include bitterness, pungency (or heat/spiciness), an unpleasant odor, sourness, coldness, and combinations thereof. An aversive agent may also act by causing humans and/or animals to vomit, for example via emetic agents. Suitable aversive agents include bittering agents, pungent agents, emetic agents, and mixtures thereof.

The level of aversive agent used may be at least at an effective level, which causes the desired aversive effect, and may depend on the characteristics of the specific aversive agents, for example bitter value. The level used may also be at or below such a level that does not cause undesired transfer of the aversive agents to a human and/or animal, such as transfer to hands, eyes, skin, or other body parts. The aversive agent may be present at a concentration which elicits repulsive behavior within a maximum time of six seconds in cases of oral exposure.

The aversive agent may be selected from the group comprising naringin; sucrose octaacetate; denatonium benzoate; capsicinoids (including capsaicin); vanillyl ethyl ether; vanillyl propyl ether; vanillyl butyl ether; vanillin propylene; glycol acetal; ethylvanillin propylene glycol acetal; gingerol; 4-(1-menthoxymethyl)-2-(3'-methoxy-4'-hydroxy-phenyl)-1, 3-dioxolane; pepper oil; pepperoleoresin; gingeroleoresin; nonylic acid vanillylamide; jamboo oleoresin; Zanthoxylum piperitum peel extract; sanshool; sanshoamide; black pepper extract; chavicine; piperine; spilanthol; and mixtures thereof. Other suitable aversive agents are described in more detail below.

Water-Soluble Film

The film of the present invention is soluble or dispersible in water.

The water-soluble film preferably has a thickness of from 20 to 200 microns, preferably 35 to 150 microns, even more preferably 50 to 125 microns, most preferably from 75 to 100 microns, or 76 microns, or 100 microns. Preferably, the water-soluble film prior to being made into a water-soluble unit dose article has a thickness between 20 μm and 200 μm, preferably between 35 μm and 150 μm, even more preferably between 50 μm and 125 μm, most preferably between 75 μm and 100 μm or 76 microns, or 100 microns. Herein we mean the thickness of the film before it has been subjected to any thermoforming, elastic strain or plasticization techniques such as thermoforming into a mould for example or stretching from general film handling.

Different film material and/or films of different thickness may be employed in making the compartments of the present invention. A benefit in selecting different films is that the resulting compartments may exhibit different solubility or release characteristics.

Preferred films exhibit good dissolution in cold water, meaning unheated distilled water. Preferably such films exhibit good dissolution at temperatures 24° C., even more preferably at 10° C. By good dissolution it is meant that the film exhibits water-solubility of at least 50%, preferably at least 75% or even at least 95%, as measured, by the method set out here after using a glass-filter with a maximum pore size of 20 microns, described below. Water-solubility may be determined at 24° C., or preferably at 10° C.

Dissolution Method: 50 grams±0.1 gram of film material is added in a pre-weighed 400 ml beaker and 245 ml±1 ml of distilled water is added. This is stirred vigorously on a magnetic stirrer, labline model No. 1250 or equivalent and 5 cm magnetic stirrer, set at 600 rpm, for 30 minutes at 24° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion, or blown extrusion of the polymeric material, as known in the art. Preferably the film is obtained by an extrusion process or by a casting process.

Preferred polymers (including copolymers, terpolymers, or derivatives thereof) suitable for use as film material are selected from polyvinyl alcohols (PVA), polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the polymers of the film material are free of carboxylate groups.

Preferably, the level of polymer in the film material, for example a PVA polymer, is at least 60%. The polymer can have any weight average molecular weight, preferably from about 1000 to 1,000,000, more preferably from about 10,000 to 300,000, yet more preferably from about 20,000 to 150,000.

Mixtures of polymers can also be used as the film material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000 to about 40,000, preferably about 20,000, and of PVA or copolymer thereof, with a weight average molecular weight of about 100,000 to about 300,000, preferably about 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers, preferably polyvinyl alcohol, which are from about 60% to about 99% hydrolysed, preferably from about 80% to about 99% hydrolysed, even more preferably from about 80% to about 90% hydrolysed, to improve the dissolution characteristics of the material. Preferred films are those supplied by Monosol (Merrillville, Ind., USA) under the trade references M8630, M8900, M8779, M8310, M9467, and PVA films of corresponding solubility and deformability characteristics. Other suitable films may include called Solublon® PT, Solublon® GA, Solublon® KC or Solublon® KL from the Aicello Chemical Europe GmbH, the films VF-HP by Kuraray, or the films by Nippon Gohsei, such as Hi Selon. Suitable films include those supplied by Monosol for use in the following Procter and Gamble products: TIDE PODS, CASCADE ACTION PACS, CASCADE PLATINUM, CASCADE COMPLETE, ARIEL 3 IN 1 PODS, TIDE BOOST ORIGINAL DUO PACs, TIDE BOOST FEBREZE SPORT DUO PACS, TIDE BOOST VIVID WHITE BRIGHT PACS, DASH, FAIRY PLATINUM. It may be preferable to use a film that exhibits better dissolution than M8630 film, supplied by Monosol, at temperatures 24° C., even more preferably at 10° C.

Preferred water soluble films are those derived from a resin that comprises a blend of polymers, preferably wherein at least one polymer in the blend is polyvinyl alcohol. Preferably, the water soluble film resin comprises a blend of PVA polymers. For example, the PVA resin can include at least two PVA polymers, wherein as used herein the first PVA polymer has a viscosity less than the second PVA polymer.

The film material herein can also comprise one or more additive ingredients. For example, the film preferably comprises a plasticizing agent. The plasticizing agent may comprise water, glycerol, ethylene glycol, diethylene glycol, propylene glycol, diproypylene glycol, sorbitol, or mixtures thereof. In some aspects, the film comprises from about 2% to about 35%, or from about 5% to about 25%, by weight of the film, a plasticizing agent selected from group comprising water, glycerol, diethylene glycol, sorbitol, and mixtures thereof. In some aspects, the film material comprises at least two, or preferably at least three, plasticizing agents. In some aspects, the film is substantially free of ethanol, meaning that the film comprises from 0% (including 0%) to about 0.1% ethanol by weight of the film. In some aspects, the plasticizing agents are the same as solvents found in an encapsulated liquid composition.

Other additives may include water and functional detergent additives, including surfactant, to be delivered to the wash water, for example, organic polymeric dispersants, etc. Additionally, the film may comprise an aversive agent, further described herein.

The water-soluble unit dose article may comprise an area of print. The water-soluble unit dose article may be printed using flexographic techniques, ink jet printing techniques or a mixture thereof. The printed are may be on the film, preferably on the outside of the film, within the film, on the inside of the film or a mixture thereof. The printed area may convey information such as usage instructions, chemical safety instructions or a mixture thereof. Alternatively, the entire surface of the pouch, or substantially the entire surface of the pouch is printed in order to make the pouch opaque. The print may convey an image that reduces the risk of confusion and hence accidental ingestion of the pouch.

Process of Making the First Particle

A process of making the first particle may comprise pastillation processes, prilling processes, molding processes, extrusion processes, or a mixture thereof.

Such processes of making the first particle may comprise the steps of

- providing a carrier material (preferably having a melting point of greater than 25° C.);
- heating the carrier material (preferably to a temperature greater than the melting point of the carrier material),
- mixing a benefit agent with the heated carrier material to form a melt composition; and
- cooling the melt composition (preferably to a temperature below the melting point of the carrier material) to form the first particle.

A pastillation process for making the first particle generally comprises the steps recited above, wherein the step of cooling the melt composition comprises dispensing the melt composition drop-wise onto a cooling surface (i.e. a surface that is cooled relative to ambient temperature (e.g. 25° C.)).

A prilling process for making the first particle generally comprises the steps recited above, wherein the step of cooling the melt composition comprises dispensing the melt composition drop-wise into a cooling atmosphere (i.e. a controlled atmosphere in which the air is cooled relative ambient temperature (e.g. 25° C.)).

A molding process for making the first particle generally comprises the steps recited above, wherein the step of cooling the melt composition comprises dispensing the melt composition into a mold and further comprising the step of cooling the melt composition in the mold to form the first particle prior to releasing from the mold.

Process of Making the Water-Soluble Unit Dose Article

Those skilled in the art will be aware of how to manufacture a water-soluble unit dose article. An exemplary method is to deform a first water-soluble film into an appropriate mould to form one or more open cavities. The one or more cavities are filled with the first particle and/or other compositions. A second film is then used to close the one or more open cavities.

Method of Use

The present invention is also to a method of doing laundry comprising the steps of diluting a water-soluble unit dose article according to the present invention in water by a factor of at least 400 to form a wash liquor and then washing fabrics with said wash liquor.

The unit dose article of the present invention may be used alone in the wash operation or may be used in conjunction with other laundry additives such as fabric softeners or fabric stain removers. The unit dose article may be used in conjunction with fragrance boosting compositions such as commercially available 'Lenor Unstoppables'.

The temperature of the wash liquor may be between 10° C. and 90° C., preferably between 15° C. and 60° C., more preferably between 15° C. and 30° C. The wash process may take between 10 minutes and 3.5 hours. The wash process may comprise one or more wash cycles. At least one wash cycle may take between 5 minutes and 2 hours, preferably between 5 minutes and 60 minutes, more preferably between 5 minutes and 40 minutes. The wash process may comprise a combination of short and long cycles. Alternatively, the wash process may comprises a series of short cycles, so-called 'quick wash'. The wash process may be a 'quick wash' at lower temperature.

The articles to be washed may be contacted with the wash liquor or the wash liquor may be contacted with the articles to be washed. Alternatively, the articles to be washed may be present within a washing machine and the wash liquor is formed around them.

EXAMPLES

Example 1

Examples of the first particle are detailed in Table 1.

TABLE 1

| | 1A | 1B |
|---|---|---|
| PDMS or amino functionalized silicone or cationic or anionic silicone | 17.5 | — |

TABLE 1-continued

| | 1A | 1B |
|---|---|---|
| PEG 8000 | 82.5 | 89.2 |
| Perfume | — | 7.0 |
| Perfume micro capsules (expressed as % encapsulated oil) | — | 3.8 |

In a first aspect of example 1 unit dose articles were prepared comprising a water-soluble polyvinyl alcohol film and a first compartment wherein the first compartment comprises 1A, 1B or a mixture thereof.

Particles were made using the following method. The PEG polymer was melted in an 80±5° C. oven, weighed as a heated liquid (e.g. 49.5 grams for 17.5% bead), and added to a 60 MAX speed mix container (Flacktek, Inc., Landrum, S.C., USA). The perfume microcapsule was weighed and added to the same container as the PEG hot melt. The container, which was sealed closed with a plastic lid, was placed in an 80° C. oven for one hour to allow the contents to reach the oven temperature. The container was then removed from the oven, placed in a 60 max speed mixer holder, and speed mixed for 30 seconds at 3500 rpm in a Flacktek DAC150.FVZ-K speed mixer (Flacktek, Inc., Landrum, S.C., USA). The resulting composition mixture was then transferred to a preheated mold with indentations to form defined hemi-spherical bead shapes. A flexible joint knife was used to evenly spread the composition into the mold indentations. The composition mixture was then allowed to cool to room temperature to solidify, at which time the solid particle was removed from the mold.

In a second aspect of example 1, water-soluble unit dose articles were prepared comprising a first compartment comprising 1A, 1B or a mixture thereof, and a second compartment comprising a composition selected from 2A, 2B, 2C, 2D, 2E or 2F (table 2). The unit dose article comprised a water-soluble polyvinyl alcohol containing film.

TABLE 2

| | 2A | 2B | 2C | 2D | 2E | 2F |
|---|---|---|---|---|---|---|
| Linear $C_9$-$C_{15}$ Alkylbenzene sulfonic acid | 18.4 | 26.7 | 21.8 | 23.5 | 19.7 | 30.0 |
| C12-14 alkyl ethoxy 3 sulfate or C12-15 alkyl ethoxy 2.5 sulfate | 8.7 | 7.6 | 14.8 | — | — | — |
| $C_{12-14}$ alkyl 7-ethoxylated alcohol $C_{12-14}$ alkyl 9-ethoxylated alcohol or $C_{14-15}$ alkyl 7-ethoxylated alcohol (or mixture thereof) | 14.5 | 3.1 | 4.0 | 24.5 | 16.2 | 19.4 |
| Citric Acid | 0.7 | 0.6 | 0.7 | — | — | — |
| Fatty acid | 6.1 | 11.0 | 6.0 | 9.1 | 19.6 | 7.2 |
| HEDP or DTPA or Diethylene triamine penta methylene phosphonic acid* | 2.1 | 0.7 | 2.3 | 0.3* | 0.5* | 0.5* |
| Enzymes (protease, amylase, mannanase, cellulase, xyloglucanase, pectate lyase, lipase or mixture thereof, expressed as % enzyme raw material solutions) | 1.7 | 1.2 | 1.6 | 2.0 | 1.7 | 2.4 |
| Brightener 49 | 0.3 | 0.3 | 0.4 | 0.3 | 0.3 | 0.4 |
| Soil release polymer (SRA300 ex Clariant or Polypropylene terephthalate or Polyethylene terephthalate or mixtures thereof) | — | — | — | 0.10 | 0.12 | 0.15 |
| Ethoxylated polyethylene imine PEI 600 E20 ex BASF | 5.3 | 2.9 | 3.2 | 2.0 | 1.7 | 3.0 |
| PEG 6000/polyvinylacetate copolymer (40:60) ex BASF | 1.7 | — | 2.5 | — | — | — |
| 1,2 Propanediol | 14.9 | 16.6 | 11.5 | 6.6 | 9.4 | 6.7 |
| Glycerine | 5.0 | 4.8 | 3.8 | 4.7 | 2.0 | 12.0 |
| Ethanol | — | — | — | 1.6 | — | 5.5 |
| Water | 9.6 | 10.6 | 9.6 | 7.6 | 7.5 | 8.4 |
| Di propylene glycol | 0.2 | 0.5 | 4.0 | — | 12.0 | — |

TABLE 2-continued

| | 2A | 2B | 2C | 2D | 2E | 2F |
|---|---|---|---|---|---|---|
| Antifoam AF8017 ex Dow Corning | — | — | 0.3 | — | — | — |
| Perfume | 2.4 | 2.8 | 2.4 | 3.0 | 1.9 | 2.5 |
| Perfume micro capsules (expressed as % encapsulated oil) | — | 0.85 | — | — | — | — |
| Accusol 880 structurant ex DOW (as raw material ex supplier) | — | — | — | — | — | — |
| PPG 400 | — | — | — | — | — | — |
| Cationically modified hydroxy-ethyl cellulose* | — | — | — | — | — | — |
| Carboxy methyl cellulose | — | — | — | — | — | — |
| Hueing dye | — | — | — | — | — | — |
| Structurant (hydrogenated castor oil) | 0.13 | 0.14 | 0.13 | — | — | — |
| Mono-ethanolamine, tri-ethanolamine or NaOH (or mixture thereof) | to between pH 7.0 and 8.7 | | | | | |
| Other laundry adjuncts (sulfite, dyes, opacifiers, MgCl2, bitrex, minors, . . .) | to 100% | | | | | |

In a third aspect of Example 1, water-soluble unit dose articles were prepared comprising three compartments and a water-soluble polyvinyl alcohol containing film. The first compartment comprising 1A, 1B or a mixture thereof, the second compartment comprising 2A, 2B, 2C, 2D, 2E or 2F and the third compartment comprising a hueing dye or a cationically modified hydroxyethylcellulose.

Example 2

In example 2, the water absorption characteristics of the particles of 1B were compared to those of the particles from commercially available Dixan power mix caps. The particles of Example 1B were tested as made and also wherein the particles were grinded to a smaller size.

About 5.5 g of particulate/powder product was weighed in a small cup without lid. Separate samples of the cup with product was stored at 10° C./60% RH and at 32° C./80% RH. At fixed time intervals, samples are weighed to measure weight increase. The weight increase is summarized as % increase versus the original weight (Table 3).

TABLE 3

| Product | Storage temp (c.) | Relative Humidity (%) | Weight at start (g) | Weight increase in % of start weight 12 days | 24 days | 39 days |
|---|---|---|---|---|---|---|
| Particles (PEG, Perfume, perfume microcapsules) - Example 1B | 10 C. | 60% | 5.54 | 0.9 | 0.4 | 0.7 |
| Particles (PEG, Perfume, perfume microcapsules) - Grinded - Example 1B | 10 C. | 60% | 5.62 | 0.0 | −0.9 | −0.9 |
| Dixan power mix caps classic - Powder ex powder compartment | 10 C. | 60% | 5.46 | 9.0 | 13.4 | 19.8 |
| Particles (PEG, Perfume, perfume microcapsules) - Example 1B | 32 C. | 80% | 5.53 | 0.2 | 0.5 | 0.0 |
| Particles (PEG, Perfume, perfume microcapsules) - Grinded - Example 1B | 32 C. | 80% | 5.55 | 0.4 | 0.0 | 0.2 |
| Dixan power mix caps classic - Powder ex powder compartment | 32 C. | 80% | 5.45 | 18.0 | 21.8 | 25.1 |

As can be seen from Table 3, the particles according to the present invention absorbed far less water than those of the commercially available product. Therefore, the instances of caking of the particles of the present invention are significantly reduced.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A water-soluble unit dose article comprising a water-soluble film and at least a first internal compartment, wherein the water-soluble film comprises polyvinyl alcohol, and wherein the first internal compartment comprises one or more of a first particle, wherein the first particle has a mean particle size of between about 0.5 mm and about 5 mm, wherein the first particle comprises:

a. between about 45% and about 95% by weight of the first particle of a carrier material selected from polyethylene glycol;

b. between about 5% and about 50% by weight of the first particle of a benefit agent that comprises a freshness active, wherein the freshness active is selected from the group consisting of perfumes, encapsulated perfumes, and mixtures thereof; and c. less than about 15% by weight of the first particle of a surfactant.

2. The water-soluble unit dose article according to claim 1, wherein the first particle has a mean particle size of between about 0.5 and about 3 mm.

3. The water-soluble unit dose article according to claim 2, wherein the first particle has a mean particle size of between about 0.5 and about 1.5 mm.

4. The water-soluble unit dose article according to claim 1 wherein the first particle comprises between about 10% and about 40% by weight of the first particle of a benefit agent.

5. The water-soluble unit dose article according to claim 1, wherein the laundry benefit agent further comprises is selected from cleaning agents, malodour agents, whiteness agents, dye transfer inhibition agents or mixtures thereof.

6. The water-soluble unit dose article according to claim 1, wherein the benefit agent is a freshness active comprising encapsulated perfumes.

7. The water-soluble unit dose article according to claim 1, wherein the first particle further comprises a softening active selected from the group comprising silicones, cellulosic polymers and mixtures thereof.

8. The water-soluble unit dose article according to claim 1 wherein the first particle comprises between about 50% and about 90%, by weight of the first particle of the carrier material.

9. The water-soluble unit dose article according to claim 8 wherein the first particle comprises between about 65% and about 85% by weight of the first particle of the carrier material.

10. The water-soluble unit dose article according to claim 1 wherein the benefit agent is comprised within the first particle, is coated on the outside of the first particle, or a mixture thereof.

11. The water-soluble unit dose article according to claim 1 wherein the unit dose article comprises between about 5% and about 80%, by weight of the unit dose article of the first particle.

12. The water-soluble unit dose article according to claim 11 wherein the unit dose article comprises between about 10% and about 70% by weight of the unit dose article of the first particle.

13. The water-soluble unit dose article according to claim 12 wherein the unit dose article comprises between about 15% and about 60% by weight of the unit dose article of the first particle.

14. The water-soluble unit dose article according to claim 1 wherein the unit dose article further comprises a second compartment and wherein the second compartment comprises a liquid composition.

15. The water-soluble unit dose article according to claim 1, wherein the unit dose article comprises at least a first and a second compartment, wherein the second compartment comprises a second particle, and wherein the second particle comprises greater than about 20% by weight of the second particle of a surfactant.

16. The water-soluble unit dose article according to claim 1 wherein the surfactant is selected from anionic surfactants, non-ionic surfactants, cationic surfactants or a mixture thereof.

17. The water-soluble unit dose article according to claim 1 wherein the unit dose article further comprises a second compartment, wherein the first internal compartment and the second compartment are arranged in a side-by-side orientation or are superposed onto one another.

18. The water-soluble unit dose article according to claim 1, wherein the polyethylene glycol has a molecular weight of between 6000 and 10,000 daltons.

19. The water-soluble unit dose article according to claim 14, wherein the liquid composition in the second compartment comprises a surfactant.

20. The water-soluble unit dose article according to claim 19, wherein the surfactant of the liquid composition is selected from the group consisting of anionic surfactants, non-ionic surfactants, cationic surfactants, and a mixture thereof.

21. The water-soluble unit dose article according to claim 19, wherein the surfactant of the liquid composition comprises an anionic surfactant selected from the group consisting of alkyl alkoxylated surfactants, linear alkylbenzene sulphonate, and mixtures thereof.

22. The water-soluble unit dose article according to claim 19, wherein the surfactant of the liquid composition comprises a non-ionic surfactant selected from the group consisting of alkoxylated fatty alcohols, oxo-synthesised non-ionic surfactants, Guerbet alcohol non-ionic surfactants, glycereth cocoate, alkyl polyglucoside or a mixture thereof.

* * * * *